US006619404B2

(12) United States Patent
Grabow

(10) Patent No.: US 6,619,404 B2
(45) Date of Patent: Sep. 16, 2003

(54) FIRE FIGHTING SYSTEM FOR A PASSENGER AIRCRAFT

(75) Inventor: Thomas Grabow, Emtinghausen (DE)

(73) Assignee: Airbus Deutschland GmbH, Hamburg (DE)

( * ) Notice: Subject to any disclaimer, the term of this patent is extended or adjusted under 35 U.S.C. 154(b) by 0 days.

(21) Appl. No.: 09/826,650

(22) Filed: Apr. 5, 2001

(65) Prior Publication Data

US 2002/0007954 A1 Jan. 24, 2002

(30) Foreign Application Priority Data

Apr. 7, 2000 (DE) ..... 100 17 500

(51) Int. Cl.[7] ..... A62C 29/00

(52) U.S. Cl. ..... 169/53; 169/51; 169/56; 169/62; 169/66; 169/54; 169/5

(58) Field of Search ..... 169/51, 53, 56, 169/62, 66, 54, 5; 244/129.2, 118.5

(56) References Cited

U.S. PATENT DOCUMENTS 2,560,091 A * 7/1951 Davis
4,566,542 A * 1/1986 Enk et al. ..... 169/62
4,643,260 A * 2/1987 Miller ..... 169/62
4,726,426 A * 2/1988 Miller ..... 169/62
5,038,867 A * 8/1991 Hindrichs et al. ..... 169/62
6,029,751 A * 2/2000 Ford et al. ..... 169/60
6,152,400 A * 11/2000 Sankrithi et al. ..... 244/118.5
6,418,752 B2 * 7/2002 Kotliar ..... 169/61

FOREIGN PATENT DOCUMENTS

EP 0234056 9/1987
WO WO81/01796 7/1981

* cited by examiner

*Primary Examiner*—Robin O. Evans
(74) *Attorney, Agent, or Firm*—W. F. Fasse; W. G. Fasse

(57) ABSTRACT

A fire fighting system is installed below deck in a passenger aircraft for protecting freight and baggage loading areas. The system has a fire extinguishing medium storage container connected through a pipe line to one or more medium discharge nozzles. A compartment such as a passenger and/or crew rest compartment installed below deck is linked to the system by a pipe line extension (10, 12, 13) connected to at least one additional fire extinguishing medium discharge nozzles in the compartment.

5 Claims, 2 Drawing Sheets

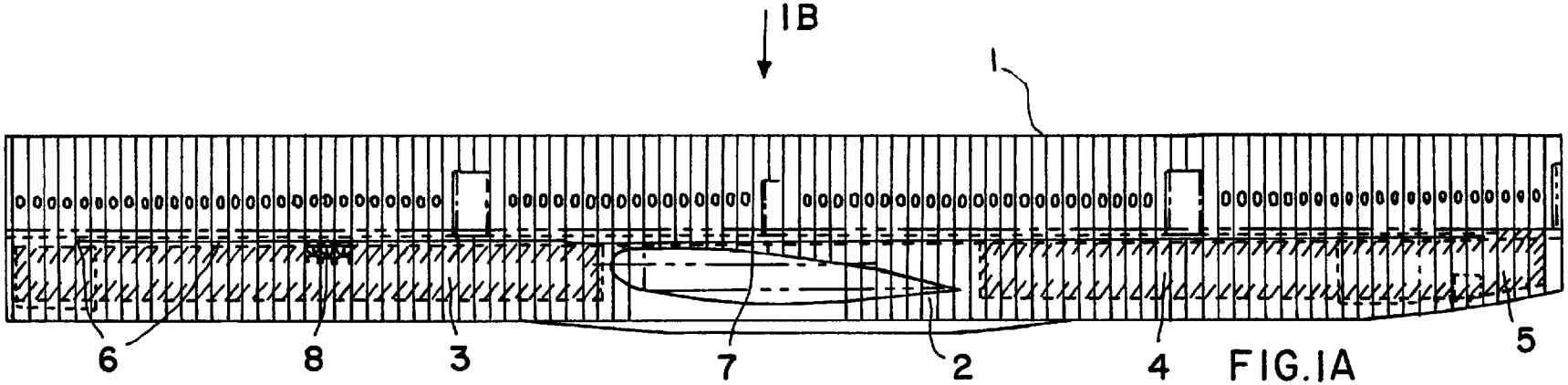
FIG.IA
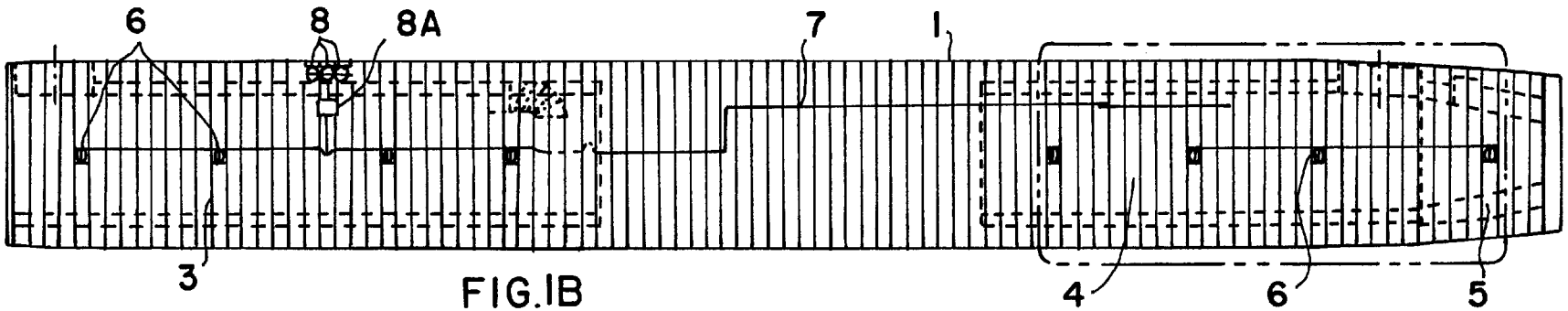
FIG.IB

FIRE FIGHTING SYSTEM FOR A PASSENGER AIRCRAFT

PRIORITY CLAIM

This application is based on and claims the priority under 35 U.S.C. §119 of German Patent Application 100 17 500.7, filed on Apr. 7, 2000, the entire disclosure of which is incorporated herein by reference.

FIELD OF THE INVENTION

The invention relates to a fire fighting system for a passenger aircraft, in particular, to large bodied passenger aircraft having at least one below deck space.

BACKGROUND INFORMATION

Conventionally, passenger aircraft are equipped with a fire fighting pipe line system installed in the aircraft body for protecting below deck installations. The system includes storage containers holding a fire extinguishing substance or medium and so-called smoke alarm hoods mechanically connected by pipes and valves of the system to the storage containers. Each smoke alarm hood includes at least one smoke detector and at least one fire fighting substance discharging nozzle. Such smoke alarm hoods are referred to herein as fire fighting unit or units. These fire fighting units are electrically connected to a control center, e.g. in the cockpit. The system further includes outlet control valves between the storage containers and the pipe line or lines. The outlet valves are also electrically connected to the control center. Thus, the outlet valves are controllable in open loop fashion or closed loop fashion from the cockpit in response to smoke alarm signals from the smoke detectors. These fire fighting units are conventionally installed in a below deck freight loading or baggage loading space of an aircraft, such as fore and/or aft freight loading spaces.

German Patent Publication DE 36 15 415 corresponding to U.S. Pat. No. 5,038,867 (Hindrichs et al.) discloses & fire fighting system including two storage containers for fire extinguishing media or substances. Such substances are liquid under excess pressure and are used in a first and in a second fire fighting mission in freight loading spaces of public transportation, particularly airliners. In these conventional systems the fire extinguishing substance becomes gaseous under atmospheric conditions and is transported from both fire extinguishing medium storage containers through a common pipe line to discharge nozzles positioned in the freight loading space or spaces in the aircraft. The conventional fire fighting system is controllable from the cockpit and has, for example, a total of four discharge nozzles. Two of these nozzles are positioned in the fore freight loading space and one nozzle each is positioned in the aft freight loading space and in the baggage loading space.

Currently, so-called LD-MCR containers (lower deck mobile crew rest container) are used in a few aircraft. Such containers are installed in areas below deck and provide a possibility for passengers and crew to have some rest during flight. It is customary to equip these temporarily used containers with individual fire extinguishers. Even similar spaces or cabins forming a fixed part of a below deck space, rather than a container, are conventionally equipped with individual fire extinguishers. Such spaces or cabins include, for example BCR compartments (bulk crew rest compartments) and other LDF rooms (lower deck facilities).

The separate or individual fire extinguishers have the disadvantage of an extra effort and expense for extinguishing medium containing bottles, piping and mountings, leading to undesirable additions to the weight of the aircraft including added costs, added electrical system connections and added maintenance efforts.

OBJECTS OF THE INVENTION

In view of the foregoing, it is the aim of the invention to achieve the following objects singly or in combination:

- to avoid individual fire fighting equipment for below deck passenger and crew facilities;
- to expand available below deck freight space fire fighting equipment for use in below deck passenger and crew facilities, with little extra effort and expense;
- to avoid the use of manually operable fire extinguishers in the below deck facilities of an aircraft; and
- to optimally reduce the need for fire sealing different below deck areas from each other.

SUMMARY OF THE INVENTION

The above objects have been achieved according to the invention by one or more extensions branching off from the below deck fire fighting equipment and leading through branch pipe lines and branching elements to one or more extinguishing medium discharging nozzles in respective fire fighting units arranged in below deck passenger and/or crew compartments, which are either below deck, built-in fixed passenger resting compartments or which are containers equipped for insertion in below deck aircraft spaces for providing passenger resting facilities. The fire fighting units are then installed in the respective container or fixed, built-in facilities. In both instances the fire fighting units are directly connectable or coupled to the below deck fire fighting equipment of the aircraft.

An advantage achieved by the invention is seen in that following the activation of the fire fighting system of the freight loading spaces, the extinguishing medium flows through the branch pipe line or lines and branching elements to the discharge nozzle or nozzles in the below deck passenger area or areas affected by a fire. It is also an advantage if fire extinguishing operations are performed simultaneously in a below deck freight loading space and in a below deck passenger compartment or cabin as a matter of precaution independently of the actual location of a fire source. Further advantages are seen in that manual fire fighting individually in any below deck passenger and/or crew space is avoided, and that fire sealing requirements between below deck passenger spaces and below deck freight loading spaces are minimized because the bulkheading provided below deck contributes substantially to the required fire insulation or sealing between freight spaces and passenger spaces. Moreover, interface components between below deck passenger facilities must be properly sealed in accordance with regulations and therefore respective sealing is provided anyway. Thus, the invention can take advantage of the sealing already provided, for example, at access openings, air conditioning inlets and outlets outside the bulkheading that seals the freight loading spaces.

BRIEF DESCRIPTION OF THE DRAWINGS

In order that the invention may be clearly understood, it will now be described in connection with example embodiments, with reference to the accompanying drawings, wherein:

FIG. 1A is a schematic side sectional view of a portion of a passenger aircraft body having conventional below deck freight loading facilities;

FIG. 1B is a schematic view in the direction of the arrow IB in FIG. 1A to show below deck fire fighting facilities.

Figure 2:
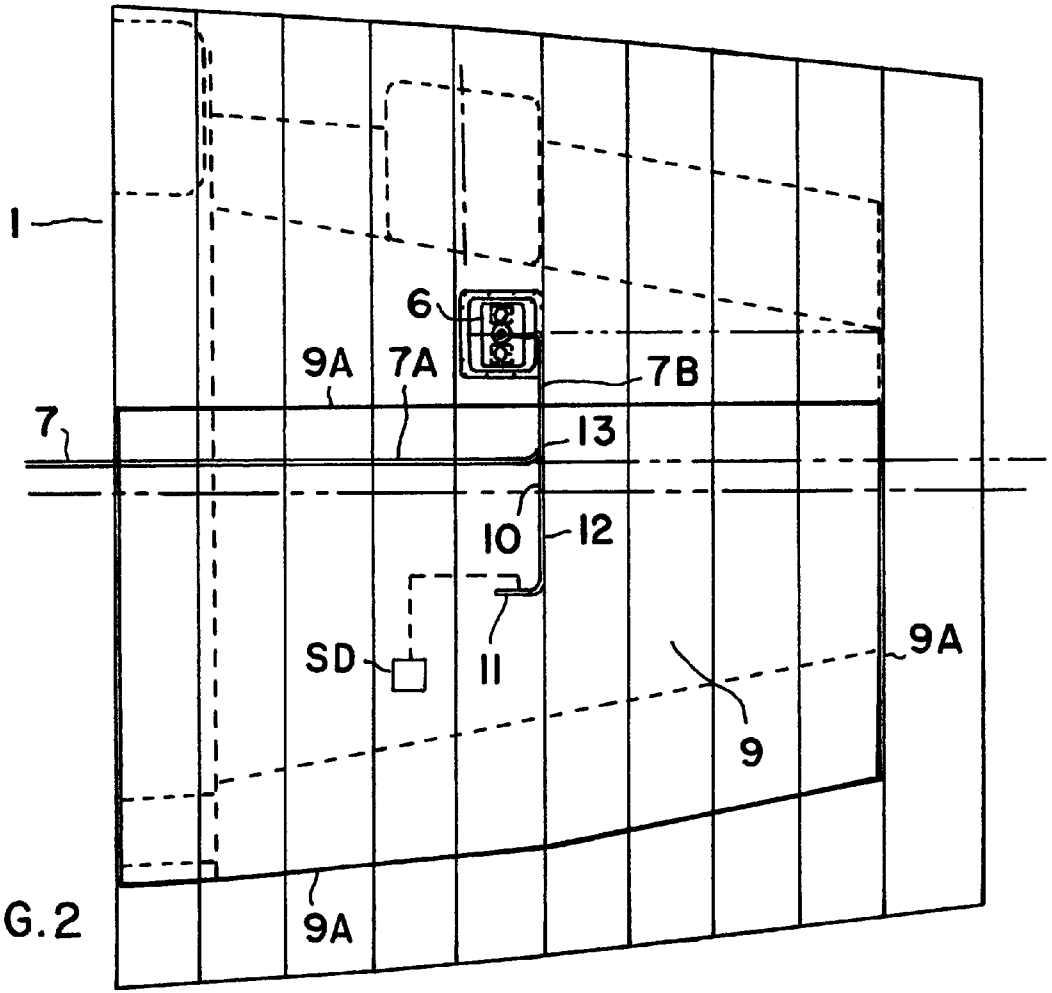
FIG. 2 shows schematically a view similar to that of FIG. 1B, but illustrating branch fire fighting facilities according to the invention for below deck passenger and/or crew compartments that may either be permanently built into the aircraft or may be a mobile container.

DETAILED DESCRIPTION OF PREFERRED EXAMPLE EMBODIMENTS AND OF THE BEST MODE OF THE INVENTION

FIGS. 1A and 1B show a conventional below deck space in an aircraft body. Such space includes a fore freight loading space 3, an aft freight loading space 4 and a baggage loading space 5. Fire fighting units 6, as described above, are installed in each of these spaces 3, 4, 5. The conventional smoke detectors and the fire extinguisher nozzles for ejecting a fire extinguishing medium are not shown in detail. These nozzles are connected through a pipe line system 7 and through an outlet control valve 8A to one or more supply containers 8 holding fire extinguishing medium.

In operation, when a fire occurs in any of the spaces 3, 4 and/or 5 that fact is detected by the smoke detector of the respective unit 6 and a respective alarm signal is supplied by the central cockpit fire control system. In response the cockpit fire control system activates the respective outlet valve or valves 8A connecting the supply container to the pipe line system 7.

FIG. 2 illustrates the position of a passenger compartment 9 installed below deck. The compartment 9 may either be permanently installed or it may be a so-called "mobile" container. In both instances the compartment 9 has walls 9A that enclose a space for use as a rest area by passengers and/or crew members.

According to the invention the pipe line system 7 is provided with an extension 10 connected through a pipe section 7A to the pipe line system 7. The extension 10 comprises a branching element such as a T-section 13 connecting a nozzle 11 for discharging fire extinguishing medium, to the pipe section 7A for receiving and discharging the medium in response to an alarm signal generated by the fire fighting unit 6 installed next to the wall 9A. This fire fighting unit 6 includes, as mentioned above, a smoke detector and a fire extinguishing medium discharge nozzle. The nozzle of the unit 6 is connected through a further branch pipe 7B and through the T-section 13 to the pipe section 7A. The nozzle 11 on the other hand is installed in the compartment 9 and thus obviates the installation of individual fire extinguishers in the compartment 9.

As shown in FIG. 2, the fire fighting unit 6 is installed outside of the compartment 9 while the nozzle 11 is installed inside the compartment 9. Such installation is adequate for certain minimal requirements. However, it is preferred to also install at least one smoke detector SD in the compartment 9. A dashed line between the smoke detector SD and the nozzle 11 indicates that the nozzle 11 may also be activated by a signal from the smoke detector SD. All smoke detectors are electrically connected to the above mentioned central control in the cockpit. The central control in turn is connected to the nozzles and valves for providing activating signals as described above.

Although the invention has been described with reference to specific example embodiments, it will be appreciated that it is intended to cover all modifications and equivalents within the scope of the appended claims. It should also be understood that the present disclosure includes all possible combinations of any individual features recited in any of the appended claims.

What is claimed is:

1. A passenger aircraft comprising below deck at least one cargo space and a cargo fire fighting system for said cargo space, said aircraft further comprising below deck facilities including at least one compartment (9) for purposes other than cargo loading, said cargo fire fighting system comprising cargo fire fighting units (6) installed in said at least one cargo space below deck, and including at least one smoke detector and at least one discharge nozzle for discharging a fire extinguishing medium into said at least one cargo space below deck and at least one fire extinguishing medium supply container (8) as part of said cargo fire fighting system, said aircraft further comprising a pipe line system (7) connecting said supply container (8) to said at least one discharge nozzle in said at least one cargo space, and a pipe extension (10, 12, 13) connected to said pipe line system (7), said pipe extension leading into said compartment (9) below deck, at least one additional nozzle (11) installed in said compartment (9) below deck and connected to said pipe extension (10, 12, 13, for discharging fire extinguishing medium in said compartment (9), whereby said cargo fire fighting system is useable for fighting a cargo fire and for fighting a compartment fire below deck with the same fire extinguishing medium.

2. The aircraft of claim 1, said at least one compartment (9) is a passenger compartment permanently installed below deck of said passenger aircraft with said at least one additional nozzle (11) installed in said passenger compartment.

3. The aircraft of claim 1, wherein said at least one compartment (9) is a container removably installed below deck of said passenger aircraft, with said at least one additional nozzle installed in said removable container.

4. The aircraft of claim 3, wherein said removable container is a passenger rest area with said additional nozzle (11) installed in said rest area.

5. The aircraft of claim 1, further comprising at least one smoke detector (SD) installed in said compartment (9) below deck.

* * * * *

UNITED STATES PATENT AND TRADEMARK OFFICE

CERTIFICATE OF CORRECTION

PATENT NO. : 6,619,404 B2
DATED : September 16, 2003
INVENTOR(S) : Grabow

It is certified that error appears in the above-identified patent and that said Letters Patent is hereby corrected as shown below:

Column 1,
Line 40, after “discloses”, replace “&” by -- a --.

Column 4,
Line 36, after “extension”, replace “(10, 12, 13,” by -- (10, 12, 13) --;
Line 41, after “claim 1,”, insert -- wherein --

Signed and Sealed this

Twentieth Day of January, 2004

JON W. DUDAS
*Acting Director of the United States Patent and Trademark Office*